US006843959B2

(12) United States Patent
Anderson

(10) Patent No.: US 6,843,959 B2
(45) Date of Patent: Jan. 18, 2005

(54) MIXER

(75) Inventor: Edward E. Anderson, Salem, MO (US)

(73) Assignee: Quality Machine Works, Inc., Salem, MO (US)

( * ) Notice: Subject to any disclaimer, the term of this patent is extended or adjusted under 35 U.S.C. 154(b) by 136 days.

(21) Appl. No.: 10/306,230

(22) Filed: Nov. 26, 2002

(65) Prior Publication Data

US 2004/0100001 A1 May 27, 2004

(51) Int. Cl.[7] ..... C21D 11/00
(52) U.S. Cl. ..... 266/233; 266/235
(58) Field of Search ..... 266/235, 233

(56) References Cited

U.S. PATENT DOCUMENTS 2,317,098 A * 4/1943 Gough ..... 310/66
4,940,214 A * 7/1990 Gillespie ..... 266/235

* cited by examiner

*Primary Examiner*—Scott Kastler
(74) *Attorney, Agent, or Firm*—Hovey Williams LLP

(57) ABSTRACT

A mixer (10) for mixing molten metal in a kettle is disclosed. The mixer (10) broadly includes a housing (12), a drive train assembly (14) supported on the housing (12), and an impeller assembly (16) rotatably coupled to the drive train assembly (14). The drive train assembly (14) broadly includes a power source (18), a rotatable shaft (20), and a transmission (22) drivingly connecting the power source (18) and the shaft (20). The housing (12) is a self-contained unit that supports the mixer (10) and includes an upper housing section (24) that is shiftable relative to a lower housing section (26) between a raised position and a lowered positioned. The transmission (22) includes an endless belt (118) than entrains a fan (122) fixed to the shaft (20). The fan (122) forces a stream of air over bearings (106,108) that support the shaft (20) and over the power source (18) when the shaft (20) is rotated.

18 Claims, 4 Drawing Sheets

MIXER

BACKGROUND OF THE INVENTION

1. Field of the Invention

The present invention relates generally to equipment for mixing molten metals. More specifically, the present invention concerns a self-contained, remotely controlled mixer having forced air-cooled impeller shaft bearings.

2. Discussion of Prior Art

In the molding industry, materials are commonly molded into convenient shapes to facilitate their transport. For example, metals such as aluminum and lead are typically molded into stackable ingots of various standard weights (e.g., 65 and 100 lb. bars). In order for metals to be cast in a mold, they must be melted into a molten liquid. This is typically accomplished by heating the metal in large kettles (e.g., some kettles can hold up to 350 tons of metal and reach temperatures in excess of 1200 degrees Fahrenheit). The metals typically include various elements that may separate as they melt (e.g., in some applications various elements are added together to achieve a desired alloy). It is therefore desirable to mix the molten metal in the kettle to achieve a uniform liquid.

Mixers for mixing molten metals in a kettle are known in the art. Prior art mixers include an impeller coupled to a bearing-supported shaft that is rotated by a motor. These prior art mixers are supported on a bridge above the kettle and require an operator on the bridge to adjust the depth of the impeller in the kettle (e.g., hand-cranked height adjustment). They include gear driven transmissions connecting the motor and the shaft and the transmission and the shaft-supporting bearings are cooled in an oil bath. Unfortunately, these mixers are problematic and have several limitations. For example, the gear drives and the bearings frequently overheat causing premature wear that requires significant maintenance and downtime. In addition, it is undesirable to have an operator on the bridge for height adjustments. Moreover, prior art mixers require a separate storage rack to support the mixer when it is not in use. Furthermore, OSHA regulations now require the top of the kettles to be covered (e.g., with a lid) to reduce the escape of fumes from the kettle and prior art bridge-supported mixers are not well adapted for use with a kettle having a lid.

SUMMARY OF THE INVENTION

The present invention provides an improved mixer that does not suffer from the problems and limitations of prior art mixers set forth above. The inventive mixer provides a low-maintenance belt-driven transmission and forced-air cooled bearings. The inventive mixer further provides a self-contained housing that does not require either abridge or a storage rack and that can adjust the depth of the impeller from a remote ground location.

One aspect of the present invention concerns a mixer for rotating an impeller in a kettle filled with molten metal. The mixer broadly includes a housing, a rotatable shaft operable to couple to the impeller, a bearing rotatably supporting the shaft on the housing, a power source operable to rotate the shaft, and a transmission drivingly connecting the power source to the rotatable shaft. The transmission includes a fan that forces air over the bearing when the shaft rotates.

A second aspect of the present invention concerns a mixer for rotating an impeller in a kettle filled with molten metal. The mixer broadly includes a housing operable to be supported above the kettle, a rotatable shaft supported on the housing and operable to couple to the impeller, a power source operable to rotate the shaft, and a control assembly. The shaft extends out of the housing and into the kettle when the housing is supported above the kettle. The shaft is shiftable between a first position, wherein the shaft extends into the kettle a first distance, and a second position, wherein the shaft extends into the kettle a second distance. The first distance is greater than the second distance. The control assembly is operable to shift the shaft between the first and second positions when the housing is supported above the kettle. The control assembly includes a power actuator coupled to the housing that is operable to shift the shaft between the first and second positions and a controller in communication with the actuator that is operable to control shifting of the actuator. The controller is remotely located relative to the housing and is generally below the top of the kettle when the housing is supported above the kettle and when the power actuator is shifting the shaft between the first and second positions.

A third aspect of the present invention concerns a mixer for rotating an impeller in a kettle having a lid and being filled with molten metal. The mixer broadly includes a self-contained housing operable to removably couple to the lid, a rotatable shaft rotatably supported on the housing and being operable to couple to the impeller, a power source coupled to the housing and being operable to rotate the shaft; and a transmission contained within the housing and drivingly connecting the power source to the rotatable shaft.

A fourth aspect of the present invention concerns a mixer for rotating an impeller in a kettle filled with molten metal. The mixer broadly includes a housing, a rotatable shaft operable to couple to the impeller, a bearing rotatably supporting the shaft on the housing, a power source operable to rotate the shaft, and a transmission drivingly connecting the power source to the rotatable shaft. The transmission includes a fan operable to generate a forced stream of air. The housing includes an air duct assembly operable to split the forced stream of air into a first and second stream of air. The duct assembly directs the first stream of air over the bearing when the shaft rotates and directs the second stream of air over the power source when the shaft rotates.

A fifth aspect of the present invention concerns a mixer for mixing molten metal in a kettle having a lid. The mixer broadly includes a housing removably coupled to the lid, a rotatable shaft extending out of the housing and into the kettle, a bearing rotatably supporting the shaft on the housing, an impeller coupled to the end of the shaft extending into the kettle and being operable to mix the molten metal, a power source operable to rotate the shaft, and a transmission drivingly connecting the power source to the rotatable shaft. The transmission includes an endless belt rotated by the power source that extends between the power source and the rotatable shaft and a fan operable to generate a forced stream of air. The fan forces the stream of air over the bearing when the power source rotates the belt.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
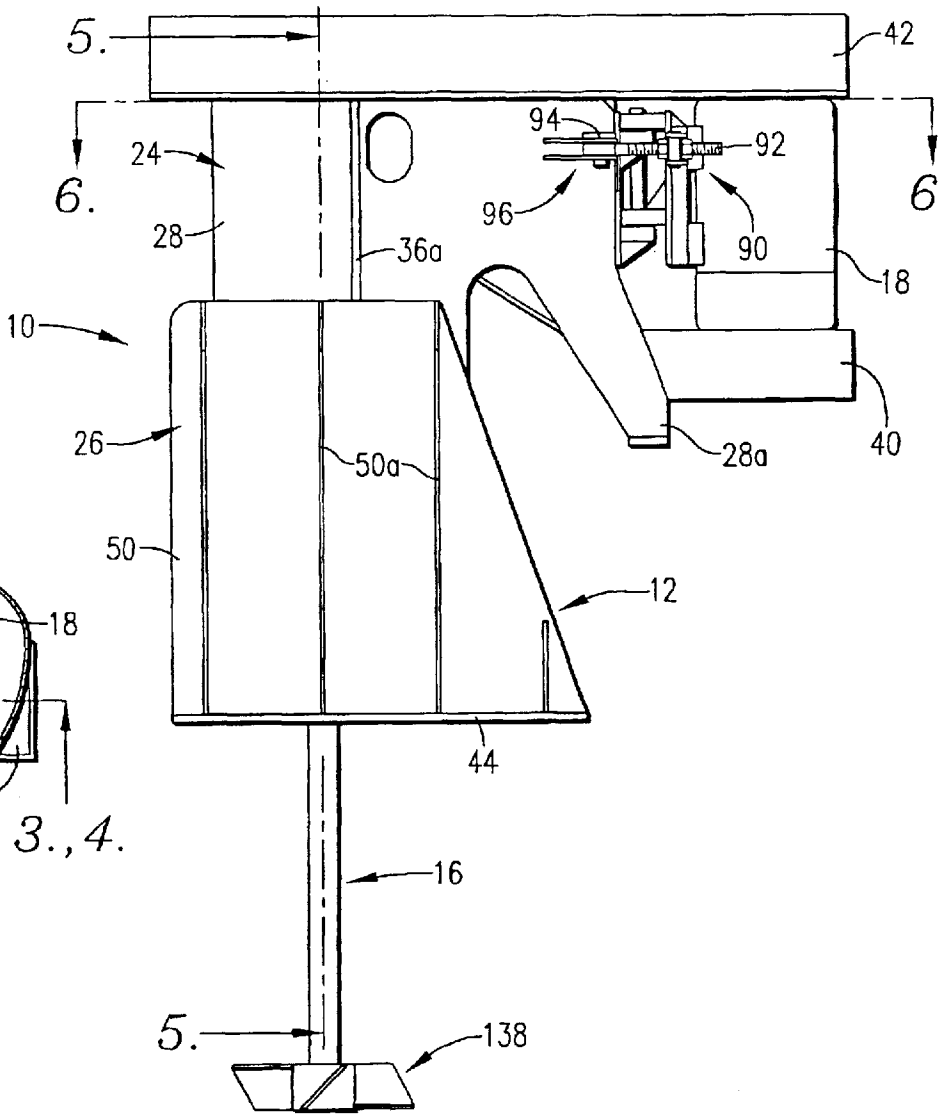
FIG. 1 is a side elevational view of a mixer constructed in accordance with a preferred embodiment of the present invention with the upper section of the housing shown in the raised position.

FIG. 1 illustrates a mixer 10 constructed in accordance with a preferred embodiment of the present invention and configured for mixing molten metals in a kettle (not shown). The mixer 10 preferably is removably coupled to a lid (not shown) for placement above the kettle so that the impeller extends into the kettle and is offset relative to the center of the kettle. For example, the mixer 10 could be directly bolted to the lid above an aperture for the shaft and impeller to extend through or the mixer 10 could be coupled to a tub that sits in a cutout in the lid offset from the center of the lid. While the principles of the present invention provide for a mixer that is well suited for mounting on the lid of a metal-filled kettle, many of the inventive features are equally applicable to various other applications (e.g., bridge-mounted mixers, mixers used in other industrial settings, etc.). The mixer 10 broadly includes a housing 12, a drive train assembly 14 supported on the housing 12, and an impeller assembly 16 rotatably coupled to the drive train assembly 14 (see FIGS. 1 and 2). The drive train assembly 14 broadly includes a power source 18, a rotatable shaft 20, and a transmission 22 drivingly connecting the power source 18 and the shaft 20 (see FIG. 3).

Figure 3:
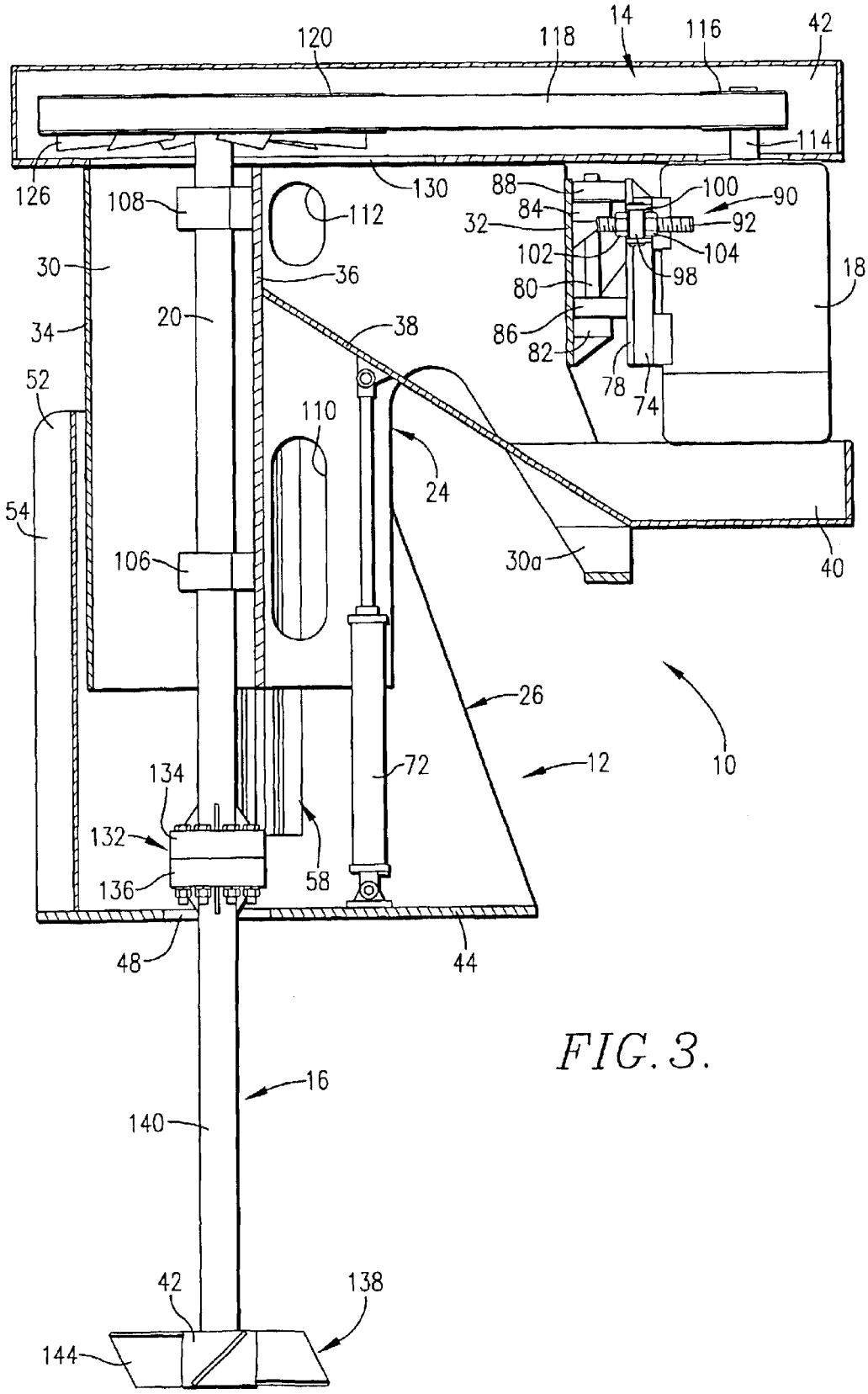
FIG. 3 is a sectional view of the mixer taken substantially along line 3—3 of FIG. 2 with the upper section of the housing shown in the raised position.

In more detail, the housing 12 includes an upper section 24 slidably mounted in a lower section 26. As shown in FIG. 3, the upper section 24 houses the power source 18, the transmission 22, and supports the shaft 20. The upper section 24 includes a pair of generally parallel, spaced apart side walls 28 and 30 separated by three transverse walls—a front wall 32, a rear wall 34, and an intermediate shaft-supporting wall 36 (see FIGS. 1, 3–5, and 6). For purposes that will subsequently be described, the intermediate wall 36 bisects each of the side walls 28,30 so that the outermost side portions 36*a* and 36*b* of the wall 36 extend out beyond the respective side wall 28,30 (see FIG. 6). Each of the side walls 28,30 include a corresponding leg portion 28*a* and 30*a*. The upper section 24 further includes a bottom wall 38 extending from the front side of the intermediate wall 36 angling down between the side walls 28,30 and projecting out of the leg portions 28*a*,30*a*. For purposes that will subsequently be described, formed in the portion of the bottom wall 38 that extends beyond the leg portions 28*a*,30*a* is a flume 40 (see FIGS. 3 and 4). At the top of the upper section 24 of the housing 12 is a belt guard assembly 42 as will subsequently be described in detail. The above described walls of the upper section 24 are preferably formed of a hard, high strength metal (e.g., steel).

Figure 9:
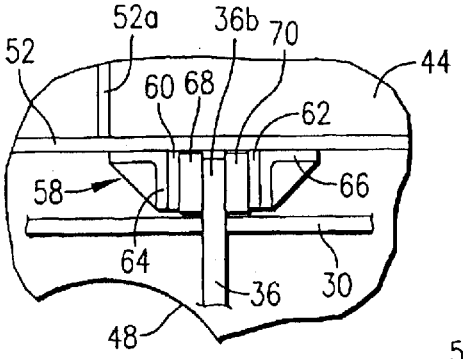
FIG. 9 is an enlarged fragmentary view of the housing illustrating one of the channel guide assemblies that shiftably couples the upper and lower sections of the housing.
Figure 6:
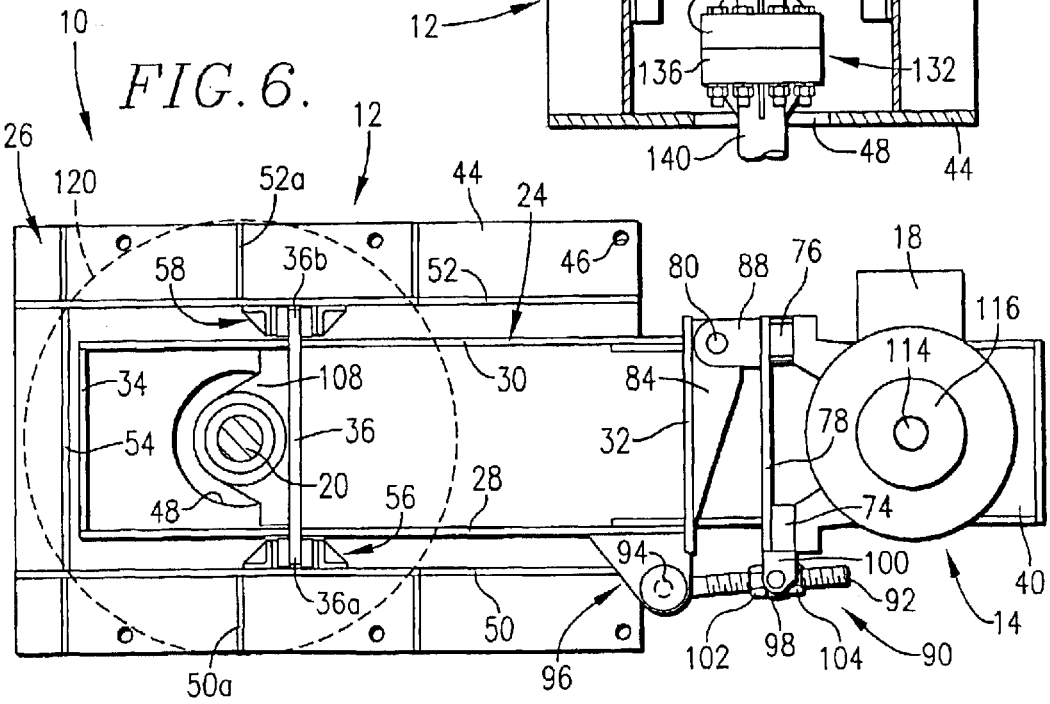
FIG. 6 is a sectional view of the mixer taken substantially along line 6—6 of FIG. 1 with the driven pulley shown in phantom lines.

The lower section 26 of the housing 12 is adapted to be removably coupled above a kettle (e.g., to a lid covering the top of the kettle). In this regard, as shown in FIG. 6, the lower section 26 includes a horizontally extending base plate 44 including apertures 46 formed therein (e.g., for bolting the plate 44 to the lid). The base plate 44 further includes a shaft-receiving aperture 48 formed therein and sufficiently dimensioned to allow the rotatable shaft 20 to freely rotate and shift through the aperture 48 (see FIGS. 3–6). Fixed to the base plate 44, and extending upward therefrom, are generally parallel, spaced apart, lateral walls 50 and 52 separated by a rear transverse wall 54. The lateral walls 50,52 are gusseted to the base plate 44 by corresponding gussets 50*a* and 52*a*. Similar to the upper section 24, the above described components of the lower section 26 are preferably formed of a hard, high strength metal (e.g., steel). The walls 50,52,54 are dimensioned to provide sufficient clearance for the upper section 24 to be slidably received within the lower section 26. In this regard, fixed to the inside surface of each of the lateral walls 50,52 are channel guide assemblies 56 and 58, respectively (see FIG. 6). The channel guide assemblies 56,58 are virtually identical and therefore only the channel guide assembly 58 will be described in detail with the understanding that the channel guide assembly 56 is similarly configured. As shown in FIG. 9, the channel guide assembly 58 includes a pair of channel guides 60 and 62, each one being fixed to the lateral wall 52 by a corresponding gusseted angle support 64 and 66. Supported between the pair of channel guides 60,62 are a pair of bushings 68 and 70. The outermost portion 36*b* of the intermediate wall 36 of the upper housing section 24 is slidably received between the pair of bushings 68,70.

Figure 4:
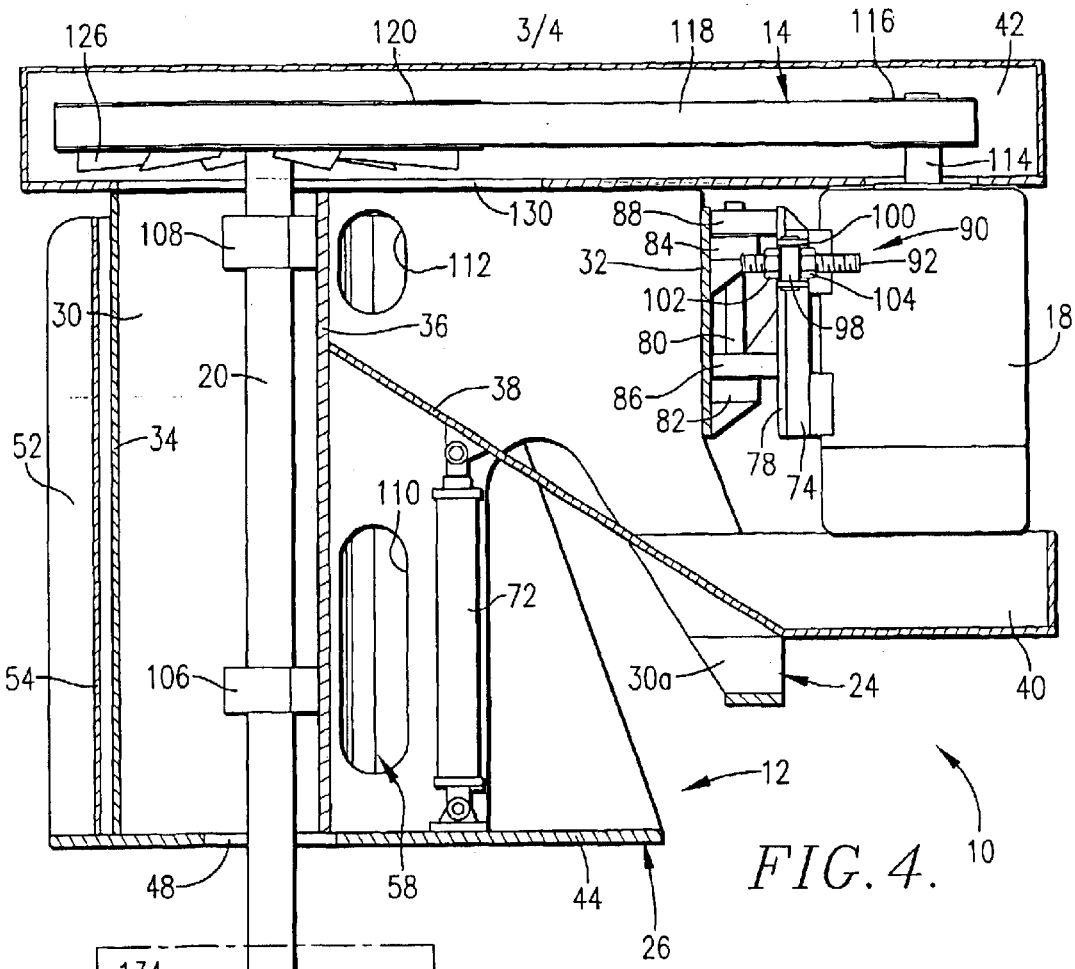
FIG. 4 is a sectional view of the mixer taken substantially along line 4—4 of FIG. 2 with the upper section of the housing shown in the lowered position.

For purposes that will subsequently be described, the upper housing section 24 is shiftable relative to the lower housing section 26 between a raised position as shown in FIG. 3 and a lowered positioned as shown in FIG. 4. In this regard, shifting of the upper housing section 24 is controlled by a control assembly including a power actuator 72 (e.g., a pneumatic or hydraulic piston and cylinder assembly) and a controller (not shown). The power actuator 72 is coupled between the base plate 44 of the lower section 26 and the inclined portion of the bottom wall 38 of the upper section 24. The controller is in communication with the actuator 72 and is operable to control shifting of the actuator 72. In the illustrated mixer 10, the actuator 72 is connected to source of pressurized air (not shown) and the controller includes a solenoid valve (not shown) that controls the flow of the pressurized air to and from the actuator 72. The solenoid valve is controlled by a switch (not shown) that is remotely located relative to the housing 12 (e.g.,. on the ground and spaced from the kettle). In this manner, when the housing 12 is mounted in an operating position on a kettle, an operator can control the shifting of the upper section 24 while standing on the ground away from the kettle. It is within the ambit of the present invention to utilize various alternative control assemblies, however, the control assembly preferably allows an operator to control the mixer from a location remote from the mixer and kettle. For example, the control assembly could utilize a receiver operable to receive control signals (e.g., radio frequencies, light, etc.) and a transmitter operable to generate multiple channels of the control signals (e.g., to control power, speed, impeller depth, etc.).

It is within the ambit of the present invention to utilize a single-body, non-shiftable housing rather than the illustrated shiftable, dual-body configuration. For example, in one manner known in the art, the housing could be configured to couple to a bridge that is height-adjustable relative to the kettle for controlling the depth of the impeller. In this regard, the upper section 24 of the housing 12 is readily convertible to such a single-body application (e.g., remove the lower section 26 and gusset a base plate to the upper section 24). In addition, the leg portions 28*a*,30*a* of the side walls 28,30 are adapted to be coupled to a bridge. Whether the housing 12 is used as a single-body bridge-mounted application or a dual-body lid-mounted application, the upper section 24 can be mounted with a gambrel (not shown) for removably coupling the housing 12 to a crane for installing the mixer 10 on the bridge, lid, etc.

Figure 2:
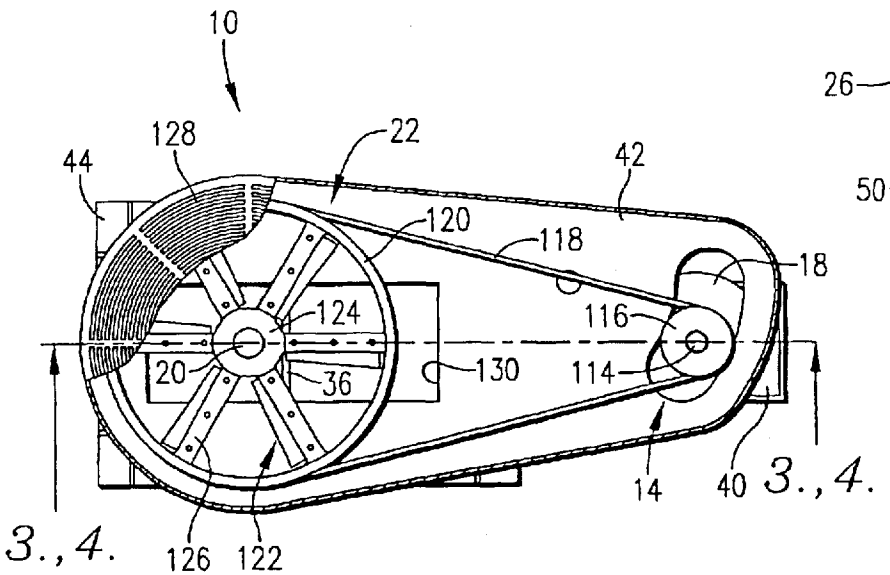
FIG. 2 is a top plan view of the mixer with a portion of the top of the housing broken away to illustrate the fan and other portions of the transmission.

Turning to FIGS. 2 and 3, the drive train assembly 14 is supported on the housing 12 and includes the power source 18, the rotatable shaft 20, and the transmission 22 drivingly connecting the power source 18 and the shaft 20. The illustrated power source 18 is an electric motor, however, any suitable power source could be utilized. The power source 18 is preferably selected according to the size of the impeller assembly 16 and/or the corresponding kettle capacity. For example, in the illustrated mixer 10, the impeller assembly 16 includes a two foot diameter impeller and a suitable electric motor is a fifty horsepower inverter duty motor capable of operating at 900–1,000 rpm. Such a motor is available from a variety of manufacturers, including, for example, WEG Electric Motors of Suwanee, Ga. For purposes that will subsequently be described, the power source 18 is adjustably coupled to the upper section 24 of the housing 12. In this regard, the power source 18 is bolted to motor mounts 74 and 76 that are fixed to a mounting plate 78 with the motor mount 76 being gusseted to the plate 78 (see FIG. 6). The mounting plate 78 is pivotally coupled to the upper section 24 of the housing 12. In particular, a mounting shaft 80 is rotatably supported by a pair of shaft supports 82 and 84 that are gusseted to the front wall 32 of the upper section 24. The mounting plate 78 is pivotally coupled to the mounting shaft 80 by a pair of plate supports 86 and 88. In this manner, the power source 18 can pivot around the mounting shaft 80. Pivoting of the power source 18 is controlled by a belt tightener assembly 90 that is adjustably coupled between the side wall 28 and the motor mount 74 (see FIG. 6). In particular, a set screw 92 is pivotally coupled at its rear end to the side wall 28 by a pin 94 that is rotatably supported by a bracket assembly 96 fixed to the side wall 28 (see FIGS. 1 and 3). The set screw 92 is slidably supported at its front end by a bushing block 98 that is pivotally coupled to the motor mount 74 by a bracket assembly 100 (see FIGS. 3 and 6). Threadably coupled to the set screw 92 on either side of the bushing block 98 are a pair of adjustment nuts 102 and 104. As the adjustment nuts 102,104 are threaded along the set screw 92, the power source 18 is caused to pivot about the mounting shaft 80. As the power source 18 pivots, the set screw 92 is allowed to pivot about the pin 94.

The rotatable shaft 20 is rotatably supported on the upper section 24 of the housing 12. Particularly, the shaft 20 is supported by a pair of pillow block bearings 106 and 108 that are fixed to the rear surface of the intermediate wall 36. For assembly purposes, two pair of access cutouts 110 and 112 (only the access cutout 110 in the side wall 30 being shown) are provided in the side walls 28 and 30 (see FIGS. 1 and 3). The rotatable shaft 20 is drivingly connected to the power source 18 by the transmission 22. In particular, as shown in FIGS. 2 and 3, the power source 18 includes a drive shaft 114 extending out of the upper end of the power source 18 and projecting through the bottom plate of the belt guard assembly 42. Fixed to the distal end of the drive shaft 114 is a drive pulley 116. The drive pulley 116 is entrained by an endless belt 118 that extends rearwardly from the drive pulley 116 to entrain a driven pulley 120. The driven pulley 120 is fixed to the upper end of the rotatable shaft 20 that projects through the bottom plate of the belt guard assembly 42. The drive shaft 114 projects through an arcuate shaped opening 122 formed in the bottom plate of the belt guard assembly 42 (see FIG. 2) that allows the drive shaft 114 of the power source 18 to pivot. In this manner, the belt 118 can be adjusted (e.g., tightened or loosened) by threading the adjustment nuts 102,104 rearwardly or forwardly along the set screw 92 to cause the power source 18 to pivot on the mounting shaft 80. The transmission 22 is preferably a belt driven transmission. However, any suitable alternative transmission system could be utilized. It is important, however, that the mixer be configured to direct a forced stream of air over a portion of the drive train assembly. In this regard, the illustrated transmission 22 includes a fan 122.

The fan 122 is integrally formed with the driven pulley 120 and includes a central hub 124 coupled to the upper end of the rotatable shaft 20 and a plurality of pitched blades 126 fixed between the hub 124 and the inside circumferential surface of the driven pulley 120. In this manner, the fan 122 rotates when the power source 18 rotates the rotatable shaft 20. The blades 126 are configured to force air down into the upper section 24 of the housing 12 when the fan 122 is rotated. Formed in the top plate of the belt guard assembly 42 is a vent 128 (see FIG. 2). Formed in the bottom plate of the belt guard assembly 42 below the fan 122 is a duct opening 130 that extends to either side of the intermediate wall 36 located below the opening 130 (see FIG. 2). When the fan 122 rotates, air is drawn through the vent 128 and is forced downward through the duct opening 130. The intermediate wall 36 operates to split this forced air into two streams, a bearing-cooling stream and a motor-cooling stream. The bearing-cooling stream is forced into a bearing-cooling duct defined by the intermediate wall 36, the rear wall 34, and the side walls 28 and 30 (see FIG. 3). The bearing-cooling duct directs the bearing-cooling stream of forced air over the bearings 106 and 108 to desirably cool the bearings 106,108 during operation of the mixer 10. The shaft-receiving aperture 48 formed in the base plate 44 of the lower section 26 is sufficiently dimensioned to allow the air to exit out of the housing 12 around the shaft 20 while still allowing the base plate 44 to shield the bearings 106,108 from heat rising out of the kettle. The motor-cooling stream is forced into a motor-cooling duct defined by the intermediate wall 36, the bottom wall 38, the front wall 32, and the side walls 28 and 30. The motor-cooling duct directs the motor-cooling stream of forced air into the flume 40 where it is directed over the power source 18 to desirably cool the power source 18 during operation of the mixer 10.

While it is important that the mixer be configured to direct a forced stream of air over a portion of the drive train assembly, the mixer could be alternatively configured to generate and direct the forced stream of air in any suitable manner. For example, the forced stream of air need not be generated by a fan (e.g., it could be generated by an in-plant pneumatic system, etc.). If a fan is utilized, it need not be an integral component of the transmission, nor does it need to be powered by the power source that drives the impeller (e.g., the fan could be a separate component powered by an independent power source, etc.). The mixer could alternatively utilize separate systems to cool the bearings and the power source (e.g., the power source could implement a self-contained oil-cooled system and the bearings could be cooled with a forced stream of air, etc.).

Figure 7:
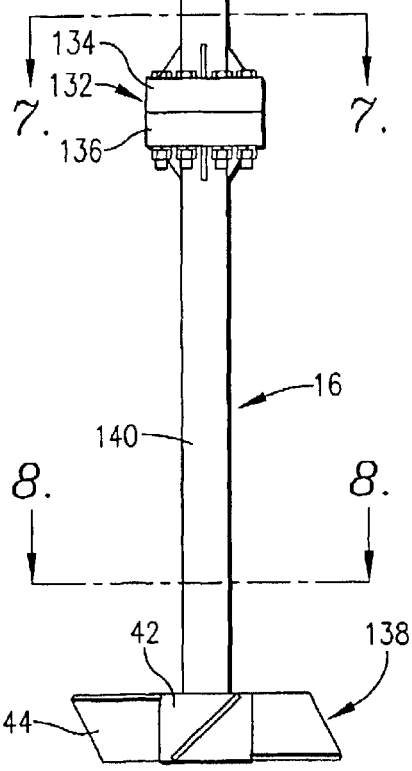
FIG. 7 is a sectional view of the mixer taken substantially along line 7—7 of FIG. 4 illustrating the coupling mechanism between the impeller assembly and the rotatable shaft.
Figure 7:
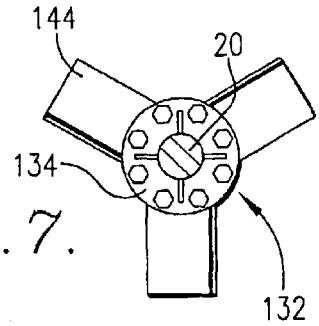
Figure 8:
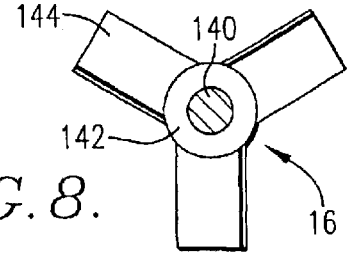
FIG. 8 is a sectional view of the mixer taken substantially along line 8—8 of FIG. 4 illustrating the hub and blades of the rotor.
Figure 5:
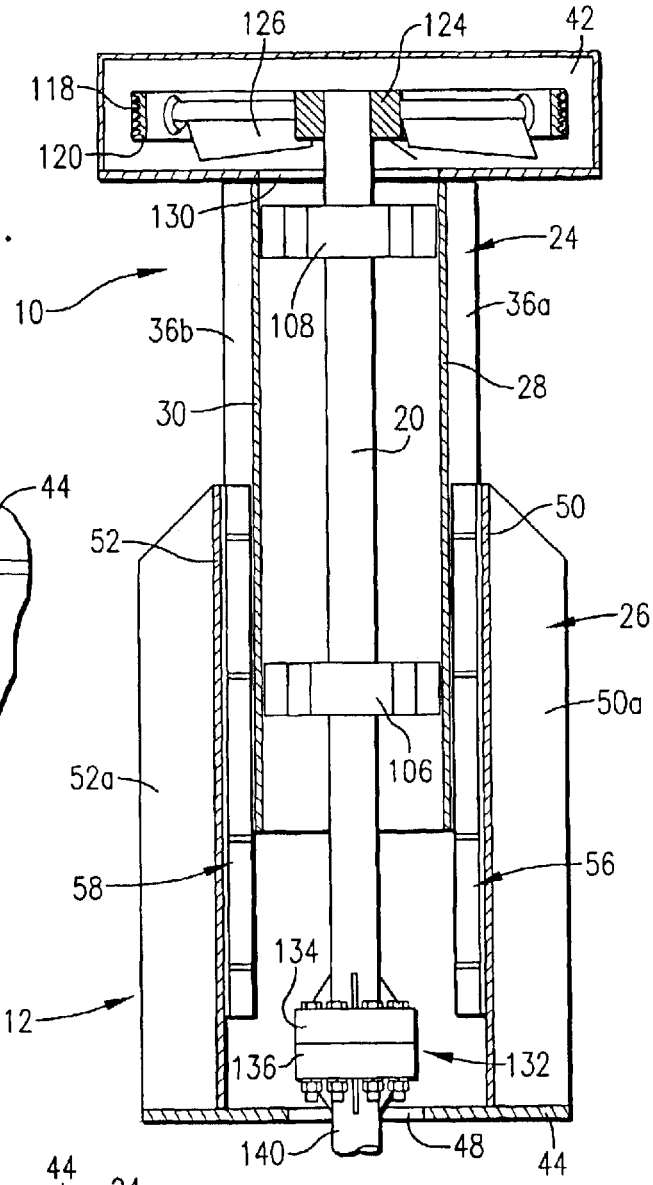
FIG. 5 is a sectional view of the mixer taken substantially along line 5—5 of FIG. 1 with a portion of the impeller shaft broken away.

As shown in FIGS. 4, 7 and 8, the impeller assembly 16 is coupled to the drive train assembly 14 and is operable to mix molten metal (e.g., molten metal in a kettle) when rotated. In particular, the impeller assembly 16 is coupled to the lower end of the rotatable shaft 20 by a coupling mechanism 132 having a shaft portion 134 and an impeller portion 136. The impeller assembly 16 includes a rotor 138, coupled to the lower end of an impeller shaft 140, and the impeller portion 136 of the coupling mechanism 132 gusseted to the upper end of the impeller shaft 140. The rotor 138 includes a rotor hub 142 coupled to the impeller shaft 140 and a plurality of pitched rotor blades 144 coupled to the rotor hub 142. When the mixer 10 is supported in an operating position above the kettle, the rotor 138 extends into the molten metal in the kettle where it preferably creates a vortex when rotated. The depth the rotor 138 extends into the kettle is varied by shifting the upper housing section 24 relative to the lower housing section 26 between the raised position as shown in FIG. 3 and the lowered positioned as shown in FIG. 4. In this manner, the rotor 138 can be skimmed toward the top surface of the molten metal in the kettle. The illustrated rotor 138 has a diameter of generally twenty-four inches and has a depth extending into the kettle that can be varied approximately twenty-four inches. However, it is within the ambit of the present invention to utilize any suitable impeller configuration, design, etc. The impeller portion 136 of the coupling mechanism 132 is removably coupled to the shaft portion 134 of the coupling mechanism 132 by a plurality of bolts. In a manner common in the art, it is within the ambit of the present invention to utilize an impeller assembly that is coupled to the mixer after, rather than during, manufacture (e.g., an impeller assembly that was manufactured by an OEM different from the OEM that manufactured all or some of the remaining components of the mixer). For example, the mixer of the present invention could be configured to accommodate various sized impeller assemblies depending on the particular application and different impeller assemblies could be easily bolted on the mixer at the application site.

The preferred form of the invention described above are to be used as illustration only, and should not be utilized in a limiting sense in interpreting the scope of the present invention. Obvious modifications to the exemplary embodiment, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A mixer for rotating an impeller in a kettle filled with molten metal, the mixer comprising:

a housing;

a rotatable shaft operable to couple to the impeller;

a bearing rotatably supporting the shaft on the housing;

a power source operable to rotate the shaft; and a transmission drivingly connecting the power source to the rotatable shaft, said transmission including a fan that forces air over the bearing when the shaft rotated, said housing defining a first duct and a second duct.

2. The mixer as claimed in claim 1, said housing including a first section and a second section, said first section being slidably received in said second section.

3. The mixer as claimed in claim 2, said bearing rotatably supporting the shaft on the first section of the housing, said second section of the housing being removably couplable to the kettle, said first section being slidable relative to the second section when the second section is removably coupled to the kettle between a first position and a second position, said shaft extending into the kettle a greater distance when the first section is in the first position than when the first section is in the second position.

4. The mixer as claimed in claim 1, said housing being operable to split the air forced by the fan into a first stream of forced air and a second stream of forced air.

5. The mixer as claimed in claim 4, said first duct directing the first stream of forced air over the bearing when the shaft rotates.

6. The mixer as claimed in claim 5, said second duct directing the second stream of forced air over the power source when the shaft rotates.

7. The mixer as claimed in claim 1, said transmission including an endless belt extending between the power source and the rotatable shaft.

8. The mixer as claimed in claim 7, said endless belt cooperating with the fan and the rotatable shaft so that the fan rotates to force air over the bearing when the shaft rotates.

9. A mixer for rotating an impeller in a kettle filled with molten metal, the mixer comprising:

a housing;

a rotatable shaft operable to couple to the impeller;

a bearing rotatably supporting the shaft on the housing;

a power source operable to rotate the shaft; and a transmission drivingly connecting the power source to the rotatable shaft, said transmission including a fan operable to generate a force stream of air;

said housing including an air duct assembly operable to split the forced stream of air into a first and second stream of air, said duct assembly directing the first stream of air over the bearing when the shaft rotates, said duct assembly directing the second stream of air over the power source when the shaft rotates.

10. The mixer as claimed in claim 9, said housing being operable to be supported over the kettle, said rotatable shaft including an upper end spaced from the kettle when the housing is supported over the kettle and a lower end extending into the kettle when the housing is supported over the kettle.

11. The mixer as claimed in claim 10, said fan being coupled to the upper end of the rotatable shaft, said transmission including an endless belt extending between the power source and the fan and being operable to rotatably couple the power source to the fan and the rotatable shaft.

12. The mixer as claimed in claim 11, said duct assembly including a first duct extending between the fan and the kettle when the housing is supported over the kettle, said bearing being located in the first duct, said first stream of air being forced through the first duct when the shaft rotates.

13. The mixer as claimed in claim 12, said duct assembly including a second duct extending between the fan and the power source, said second stream of air being forced through the second duct when the shaft rotates.

14. A mixer for mixing molten metal in a kettle having a lid, the mixer comprising:

a housing removably coupled to the lid;

a rotatable shaft extending out of the housing and into the kettle;

a bearing rotatably supporting the shaft on the housing;

an impeller coupled to the end of the shaft extending into the kettle and being operable to mix the molten metal;

a power source operable to rotate the shaft; and a transmission drivingly connecting the power source to the rotatable shaft, said transmission including an endless belt rotated by the power source and extending between the power source and the rotatable shaft and a fan operable to generate a forced stream of air, said fan forcing the stream of air over the bearing when the power source rotates the belt.

15. The mixer as claimed in claim 14, said impeller including a hub and a plurality of blades fixed to the hub.

16. The mixer as claimed in claim 15, said housing defining a duct extending vertically through the housing, said bearing being located within the duct.

17. The mixer as claimed in claim 16, said fan being generally located at the top of the duct, said fan being operable to force air through the duct over the bearing and into the kettle.

18. The mixer as claimed in claim 17, said housing including an upper section shiftable relative to the lid, said at least a portion of the rotatable shaft being supported on the upper section, said upper section being shiftable between a raised position, wherein the shaft extends through the lid and into the kettle a first distance, and a lowered position, wherein the shaft extends through the lid and into the kettle a second distance, said second distance being greater than the first distance.

* * * * *